US005409351A

United States Patent [19]

Geist

[11] Patent Number: 5,409,351

[45] Date of Patent: Apr. 25, 1995

[54] STEAM TURBINE WITH A ROTARY SLIDE

[75] Inventor: Richard Geist, Lauf, Germany

[73] Assignee: ABB Patent GmbH, Mannheim, Germany

[21] Appl. No.: 180,106

[22] Filed: Jan. 12, 1994

Related U.S. Application Data

[63] Continuation of Ser. No. 59,436, May 4, 1993, abandoned.

[30] Foreign Application Priority Data

May 4, 1992 [DE] Germany ..... 42 14 775.1

[51] Int. Cl.[6] ..... F01D 17/24

[52] U.S. Cl. ..... 415/159; 415/148; 415/150; 137/625.31

[58] Field of Search ..... 415/148, 149.1, 149.2, 415/150, 151, 154.1, 154.2, 155, 158, 159, 36, 38, 41, 44; 60/662; 251/129.11, 212; 137/625.31, 625.3

[56] References Cited

U.S. PATENT DOCUMENTS

| | | | |
|---|---|---|---|
| 707,727 | 8/1902 | Schulz | 415/149.1 |
| 793,540 | 6/1905 | Purvis | 415/44 |
| 1,291,322 | 1/1919 | Wiberg | 415/159 |
| 1,544,285 | 6/1925 | Trotter | 415/159 |
| 1,894,117 | 1/1933 | Pollard et al. . | |
| 2,184,661 | 12/1939 | Bentley | 415/159 |
| 2,186,952 | 1/1940 | Bloomberg | 415/185 |
| 3,209,537 | 10/1965 | Mock . | |
| 3,589,829 | 6/1971 | Schetinin | 415/159 |
| 3,669,562 | 6/1972 | McNally et al. | 415/159 |
| 3,860,357 | 1/1975 | Grainger . | |

FOREIGN PATENT DOCUMENTS

| | | | |
|---|---|---|---|
| 296442 | 12/1988 | European Pat. Off. . | |
| 508067 | 10/1992 | European Pat. Off. . | |
| 453079 | 9/1925 | Germany . | |
| 73042 | 5/1970 | Germany . | |
| 2301163 | 7/1973 | Germany . | |
| 165704 | 12/1981 | Japan | 415/148 |
| 7707 | 1/1984 | Japan | 415/148 |
| 1553736 | 3/1990 | U.S.S.R. . | |

OTHER PUBLICATIONS

"Der Drehschieber als Regelorgan für Entnahme-Dampfturbinen" Berlin, 1966, pp. 185–190, Book 4, (The Rotary Slike as a Regulating Device for Pass-Out Steam Turbines), Speicher et al.

"Zur Entwicklung von Niederdruck-Dampfsteuer-organen, derzeitiger Stand und künftige Möglichkeiten", Berlin, 1989, pp. 77–79, Speicher et al.

*Primary Examiner*—John T. Kwon

*Attorney, Agent, or Firm*—Herbert L. Lerner; Laurence A. Greenberg

[57] ABSTRACT

A steam turbine includes a rotary slide for controlling steam throughput, particularly in combination with a steam offtake. The rotary slide has control slits formed therein. A stationary channel body has channel inlets formed therein with which the control slits cooperate for increasingly opening and closing the channel inlets depending on a direction of rotation of the rotary slide at the time. At least one roller bearing race is disposed between the stationary channel body and the rotary slide outside the vicinity of the control slits and the channel inlets, for reducing rotational friction. At least one of the control slits and at least one of the channel inlets is disposed at each of at least two separate orbits. One of the channel inlets is opened while others of the channel inlets to be opened remain closed, upon rotation of the rotary slide in a corresponding direction of rotation.

27 Claims, 6 Drawing Sheets

STEAM TURBINE WITH A ROTARY SLIDE

This application is a continuation of application Ser. No. 08/059,436, filed May 4, 1993, now abandoned.

The invention relates to a steam turbine having a rotary slide for controlling steam throughput, particularly in combination with a steam offtake, wherein control slits provided in the rotary slide cooperate with channel inlets formed in a stationary channel body in such a way that the inlets are increasingly opened or closed depending on the direction of rotation at the time of the rotary slide.

In steam turbine engineering, valves are virtually exclusively used to control the steam, while slides are only relatively seldom used as control devices. One reason for that is surely that valves are highly reliable and have an exact operative mechanism, and another is the problems that must be solved if slides are to be used in a practical way. For instance, the static relief that is virtually taken for granted in modern valves is not readily possible with slides. Moreover, it is disadvantageous in principle that unlubricated, hot parts which might become deformed will slide on one another.

Nevertheless, a number of attempts have been made to use rotary slides, at least where the use of control valves in steam turbines with an axial flow through them necessitates not only quite complicated constructions but also quite disadvantageous flow conditions. That is particularly true for pass-out steam turbines, in which the use of a rotary slide with an axial flow through it can lead not only to advantageous flow conditions but also to a space-saving structure.

In order to control the steam throughput in steam turbines, throttle regulation or nozzle group regulation is used. The latter is especially suitable for systems in which high partial-load efficiencies are to be attained. In them, the regulating stage has a plurality of nozzle groups, and the inflow of steam to each of the nozzle groups is adjusted with a separate regulating valve. As the capacity requirement increases, it is usual to act upon one nozzle group after the other with steam, which is done with the aid of suitably controlled regulating valves or by means of the control slits of a rotary slide. For a given load state, a more-or-less large number of nozzle groups is generally fully acted upon, so that as a result no throttling takes place and the various nozzles operate at an advantageous efficiency. Only one nozzle group, in accordance with the particular position of the regulating valve or rotary slide, will undergo merely a partial impingement, and as a result will operate at lesser efficiency. However, that loss will become less as the number of nozzle groups increases, so that it is logical to conclude that as many nozzle groups as possible should be provided, and in the ideal case each individual nozzle would be triggerable. That kind of multiplication of the regulating valves would rapidly run up again engineering limits, while a corresponding embodiment of a rotary slide would be more in the range of feasibility.

Rotary slide controls are known from an article entitled "Zur Entwicklung von Niederdruck-Dampfsteuerorganen, derzeitiger Stand und zukünftige Möglichkeiten" [Development of Low-pressure Steam Control Devices: Present Status and Future Possibilities], in a periodical entitled "Maschinenbautechnik" [Mechanical Engineering], Berlin, 38 (1989), pages 17 ff. That article already contains some suggestion that rotary slides can be made for both throttle regulation and nozzle group regulation. A first variant constructed as a radial slide is described, in which a large number of blockable individual windows lead into a channel body having an annular chamber located in front of a guide grid. In a second variant, which is constructed as an axial rotary slide, a large number of blockable individual windows are also provided, which lead directly to the guide blading through a channel body. However, both versions are suitable only for throttle regulation, in which the rotary slides must be displaced from the fully opened state to the fully blocking position, in each case by only a single window spacing.

Another article entitled "Der Drehschieber als Regelorgan für Entnahme-Dampfturbinen" [The Rotary Slide as a Regulating Device for Pass-Out Steam Turbines], in the periodical Maschinenbautechnik [Mechanical Engineering], Berlin, 15 (1966), pages 185 ff, states that it is possible in nozzle group regulation to stagger the cross sections of the individual groups somewhat relative to one another. However, with a rotary slide constructed in that way, even despite a disadvantageous reduction in cross section, no more than four nozzle groups can be provided. However, so few nozzle groups could be controlled with regulating valves as well, that such a suggestion achieves no improvement in the partial-load-range efficiency of the steam turbine.

It is accordingly an object of the invention to provide a steam turbine with a rotary slide, which overcomes the hereinafore-mentioned disadvantages of the heretofore-known devices of this general type and which does so in such a way that the steam throughput per nozzle or nozzle group can be adapted in a finely graduated manner to the prevailing partial load at a given time at high efficiency, and the adjusting forces that must be employed to change the rotary slide position are as low as possible.

With the foregoing and other objects in view there is provided, in accordance with the invention, a steam turbine, comprising a rotary slide for controlling steam throughput, particularly in combination with a steam offtake, the rotary slide having control slits formed therein; a stationary channel body having channel inlets formed therein with which the control slits cooperate for increasingly opening and closing the channel inlets depending on a direction of rotation of the rotary slide at the time; at least one roller bearing race disposed between the stationary channel body and the rotary slide outside the vicinity of the control slits and the channel inlets, for reducing rotational friction; at least one of the control slits and at least one of the channel inlets being disposed at each of at least two separate orbits; and one of the channel inlets being opened while others of the channel inlets to be opened remain closed, upon rotation of the rotary slide in a corresponding direction of rotation.

A decisive improvement of the rotary slide with a view toward finely graduated regulation of the steam throughput is attained due to the fact that the control slits formed in the rotary slide are located on separate orbits, and the channel inlets associated with the orbits, which are formed in a channel body and lead to the nozzles, are disposed offset from the control slits in such a way that one channel inlet is open simultaneously, while further channel inlets that are also to be opened are still closed.

By placing control slits and channel inlets on a plurality of different orbits, it is possible to open a greater number of nozzles or nozzle groups individually, in succession, without reducing the cross section. A further substantial advantage of the invention is that with the aid of a roller bearing race, the high friction that occurs in typical rotary slides with slide bearings can be reduced decisively. One or more roller bearing races need merely be disposed in such a way that they cause no hindrance in the control region between the control slits and the channel inlets.

In principle, it is possible to place a plurality of control slits on a plurality of orbits at certain angles relative to one another and offset from the channel inlets corresponding to them, and as a result to adapt the opening behavior of the rotary slide to the desired turbine regulation.

In accordance with another feature of the invention, there are two control slits located on different orbits, they are offset by 180° from another, and the rotary angle upon adjustment of the rotary slide between the closure and the complete opening extends accordingly over 180°.

In accordance with a further feature of the invention, in order to make the rotary slide easy to install, it is slit horizontally into two rotary slide halves, which can be mounted individually on the channel body and joined together. The joining is suitably done with the aid of rotary slide parting line flanges.

In accordance with an added feature of the invention, each of the two rotary slide halves has its own control slit, and the control slit of the first rotary slide half correspondingly extends over a different orbit from that of the second rotary slide half.

The construction of the rotary slide according to the invention allows a number of variants for controlling the steam throughput. In accordance with an additional feature of the invention, individually triggerable nozzles or nozzle groups are combined with the triggering of a bypass that is also provided, in which case the bypass is the last to be opened, after the nozzles have been opened.

In accordance with yet another feature of the invention, in order to provide uniform heating of the turbine housing, steam impinges upon the housing as uniformly as possible at various points of its circumference, beginning at the lower-most power stage.

In accordance with yet a further feature of the invention, the control slits are disposed with respect to the channel inlets in such a way that two or more channel inlets, each located at the same distance from one another, are simultaneously opened or closed by the control slits.

In accordance with yet an added feature of the invention, the control slits and the channel inlets are located between two roller bearing races. Good contact of the rotary slide with the roller bearing over a wide surface area is obtained in this way.

In accordance with yet an additional feature of the invention, there is provided a preferably electric servomotor for driving the rotary slide for its adjusting movement, and a flexible cardan shaft through which the servomotor drives a drive pinion that engages a toothed ring provided on the rotary slide.

In accordance with again another feature of the invention, the channel body, like the rotary slide, is split into two halves and installed in a corresponding way above the shaft of the steam turbine.

Due to the channel inlets located on different orbits, different channel body halves are required. In accordance with again a further feature of the invention, simplified manufacture is attained by casting the two channel body halves as identical parts and only then producing the channel inlets in the channel body by means of an ensuing machining of the cast bodies.

Although leakage cannot be avoided entirely in rotary slides, it can nevertheless be reduced as much as possible in accordance with again an added feature of the invention, by providing that the roller bearing races are sunk so deep into the channel body that only a narrow gap remains between the rotary slide and the channel body, and the gap is then sealed off well by suitable provisions, in a known manner.

Despite the fact that friction is greatly reduced by the roller bearing races, some wear must be expected in the region of the running surfaces, at high contact pressures. In accordance with again an additional feature of the invention, this region on the rotary slide is tempered or hardened by detonation coating.

In accordance with still another feature of the invention, the rotary slide is to be supported rotatably on the channel body and it is suitably joined to it in such a way that the two parts interlock with one another by means of suitable annular grooves and annular cams.

In accordance with still a further feature of the invention, the channel body, in turn, is flanged to the guide blade support or suspended in the housing like a guide blade support.

In accordance with a concomitant feature of the invention, all of the characteristics described above may be employed with either an axial or a radial rotary slide and the channel body need merely be adapted accordingly.

The advantage of the radial rotary slide is that it is statically relieved in the case of steam impingement which takes place uniformly over its entire circumference, so that wear remains within limits even in the case of a slide bearing. However, it has the disadvantage of the steam deflection that is necessary in a turbine with an axial flow passing through it. In this respect, the axial rotary slide would be preferred, although it can be statically relieved only by means of relatively complicated structural forms, and the bearings must as a rule absorb the entire differential pressure.

Other features which are considered as characteristic for the invention are set forth in the appended claims.

Although the invention is illustrated and described herein as embodied in a steam turbine with a rotary slide, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
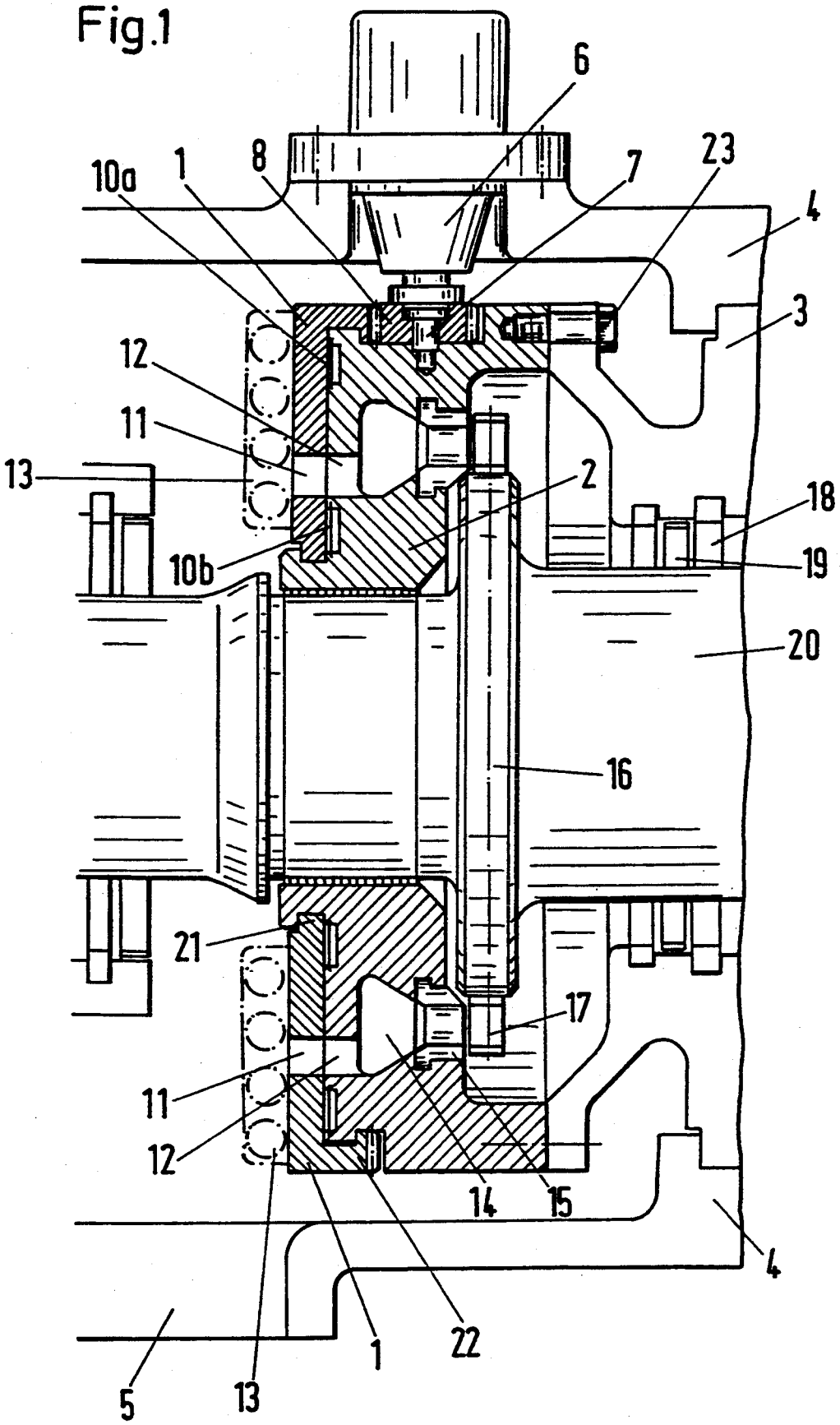
FIG. 1 is a fragmentary, diagrammatic, axial-sectional view of a steam turbine regulating stage with an axial rotary slide for nozzle group regulation, as seen in an open state.
Figure 2:
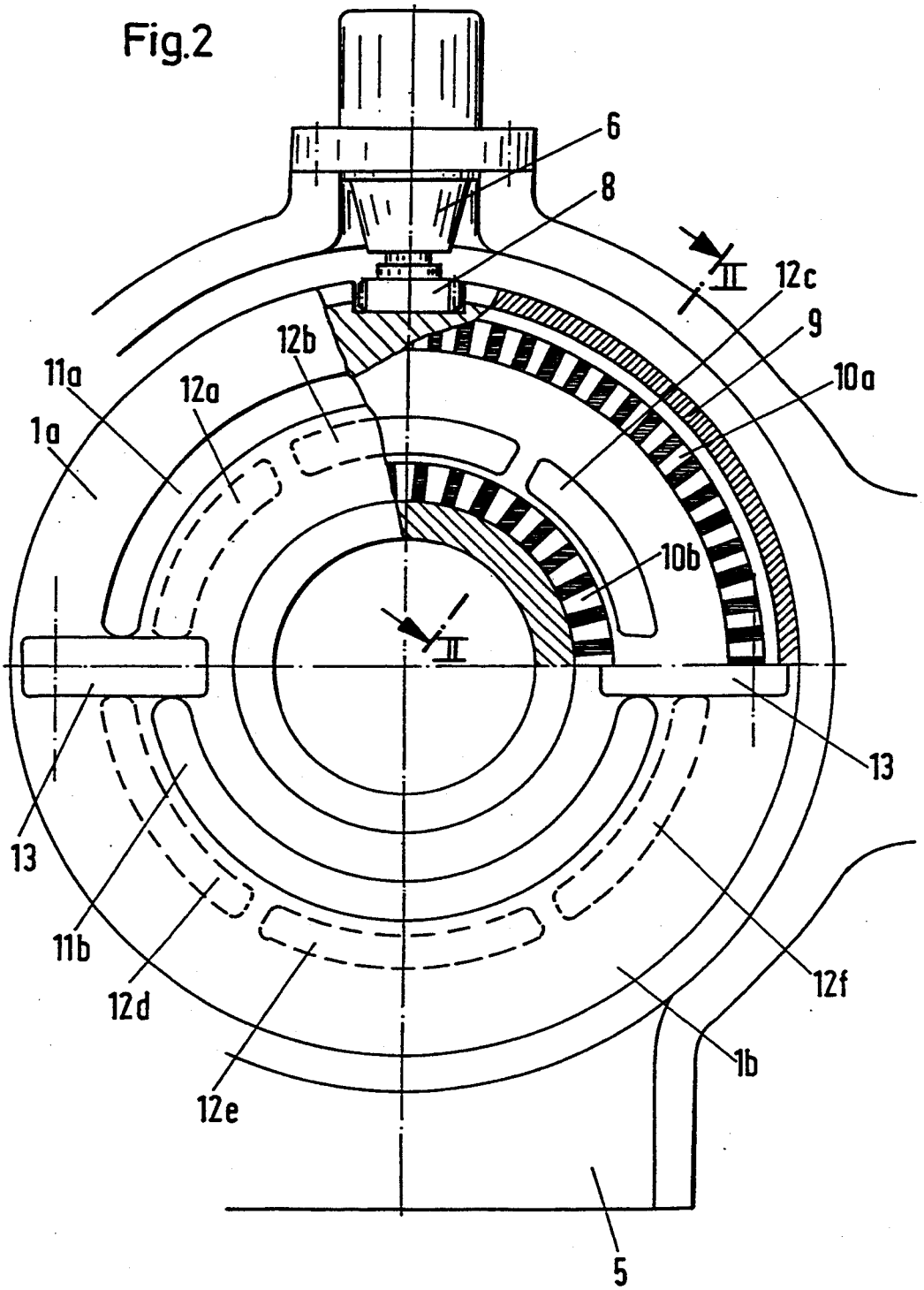
FIG. 2 is a fragmentary, axial view of a regulating stage of FIG. 1, as seen by looking toward the axial rotary slide in a closed state, which is partly broken-away and sectional to make channel inlets and roller bearing races visible.

Referring now to the figures of the drawing in detail and first, particularly, to FIGS. 1 and 2 thereof, there is seen a regulating stage of a steam turbine which is located at an interface between two turbine parts of different pressure. In this case, a pass-out steam turbine is involved, in which an offtake is effected upstream of the regulating stage through an offtake channel 5. In order to regulate steam throughput, a rotary slide 1 which is constructed as an axial rotary slide is provided and is rotatably supported on a channel body 2 that in turn is flanged in a fixed fashion to a guide blade support 3. The entire configuration is enclosed by a turbine housing 4.

Steam arriving from the high-pressure part of the steam turbine flows through the rotary slide 1 in the region of a control slit 11 and through a channel inlet 12 of the channel body 2 to reach a nozzle chamber 14, and then flows to a nozzle 15. From there, it is carried to a regulating wheel 16 with regulating wheel blades 17 and finally to rotor blades 19 located between guide blades 18, so that it can drive a turbine rotor.

As FIG. 2 shows in particular, the special structure of both the rotary slide 1 and the channel body 2 enables very finely graduated nozzle group regulation. For that purpose, the rotary slide 1 has two control slits 11*a*, 11*b* which are offset by 180° from one another, on adjacent orbits or circular paths having smaller radii than the circumference of the rotary slide. These slits correspond with the channel inlets 12 of the channel body 2. Three channel inlets 12*a*, 12*b*, 12*c* are located on a corresponding orbit having the same radius as that of the control sit 11*b* but being offset from it by a rotary angle of 180°. Correspondingly, three further channel inlets 12*d*, 12*e*, 12*f* are located on one orbit having the same radius as that of the control slit 11*a* and are again offset by a rotary angle of 180°.

While FIG. 1 shows a position of the rotary slide in which the rotary slide has opened the channel inlets 12, the rotary slide 1 of FIG. 2 is in a position which is rotated by 180°. In this position, all of the channel inlets 12 are closed. However, if the rotary slide 1 were moved clockwise, then the control slit 11*a* would first meet the channel inlet 12*f*, and the control slit 11*b* would meet the channel inlet 12*a*. The nozzle groups that communicate with the channel inlets 12*a*, 12*f* would accordingly be the first to be acted upon by steam. With an increasing power requirement, the rotary slide could be opened increasingly, in the course of which the channel inlets 12*e*, 12*b* would be the next to be engaged by the control slits 11*a*, 11*b*. After a 180° movement of the rotary slide 1, all of the channel inlets 12 would be fully opened.

As can easily be seen, two diametrically opposed channel inlets are always simultaneously acted upon by steam. This brings about a correspondingly uniform heating of the turbine housing. Naturally, it is possible for the various channel inlets 12 to be assigned different rotary angle lengths. For instance, it would be conceivable for the first two channel inlets to be assigned to a nozzle group including two or three nozzles, and then to provide only one nozzle per channel inlet for further increasing the power, in order to achieve the finest possible graduation of regulation.

In order to enable easy rotary motion, two roller bearing races 10*a* and 10*b* are provided, which may be constructed as axial needle rings for an axial rotary slide or as radial needle rings for a radial rotary slide. The roller bearing races 10*a*, 10*b* are disposed in such a way that the control slits 11 on one hand and the channel inlets on the other hand come to rest between them, thereby providing the best possible support for the rotary slide. In the case of an axial rotary slide, the roller bearing race 10*b* is an inner roller bearing race located in the vicinity of the axis and the roller bearing race 10*a* is an outer roller bearing race located toward the outside, as will be required. A toothed ring 9 is disposed farther out than the outer roller bearing race 10*a* and is provided in the region of the outer edge of the axial rotary slide 1. This ring 9 is engaged by a drive pinion 8 which is connected through a flexible cardan shaft 7 to a servomotor 6, that enables the rotary motion of the rotary slide 1 and is secured to the turbine housing 4.

In order to ensure that the rotary slide 1 and the channel body 2 can be joined together upon installation above the steam turbine shaft 20, they are split horizontally into rotary slide halves 1*a*, 1*b* and channel body halves. Thus the roller bearing rings, which may also correspond to conventional versions that are available on the market, must also be horizontally split. Through the use of parting line flanges, such as a rotary slide parting line flange 13 shown herein, it is possible for the two halves of each set to be joined together.

FIG. 1 also shows the way in which the rotary slide 1 is anchored to the channel body 2 with a cam or collar 22 on one hand and in an annular groove 21 of the channel body on the other hand. The channel body, in turn, is flanged to the guide blade support 3 with screws 23. The two roller bearing races 10*a*, 10*b* are largely sunk within the channel body 2.

Figure 3:
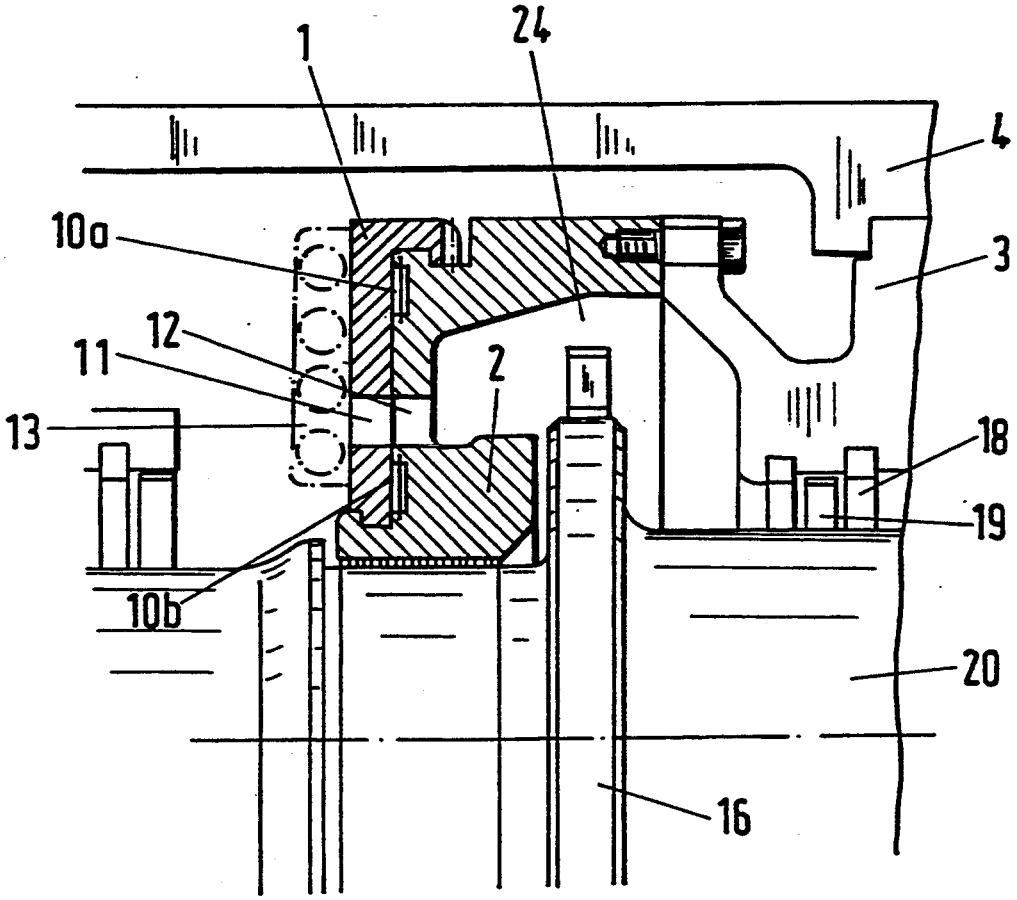
FIG. 3 is a fragmentary, axial-sectional view taken along a line I—I of FIG. 2, in the direction of the arrows, showing the regulating stage of a steam turbine with an axial rotary slide for controlling a bypass.

FIG. 3 shows the way in which a bypass is constructed in an axial rotary slide. The channel body needs to enable a flow around the regulating wheel 16 only in the region of a bypass 24. Otherwise, all of the essential details are equivalent to those of FIG. 1.

Figure 4:
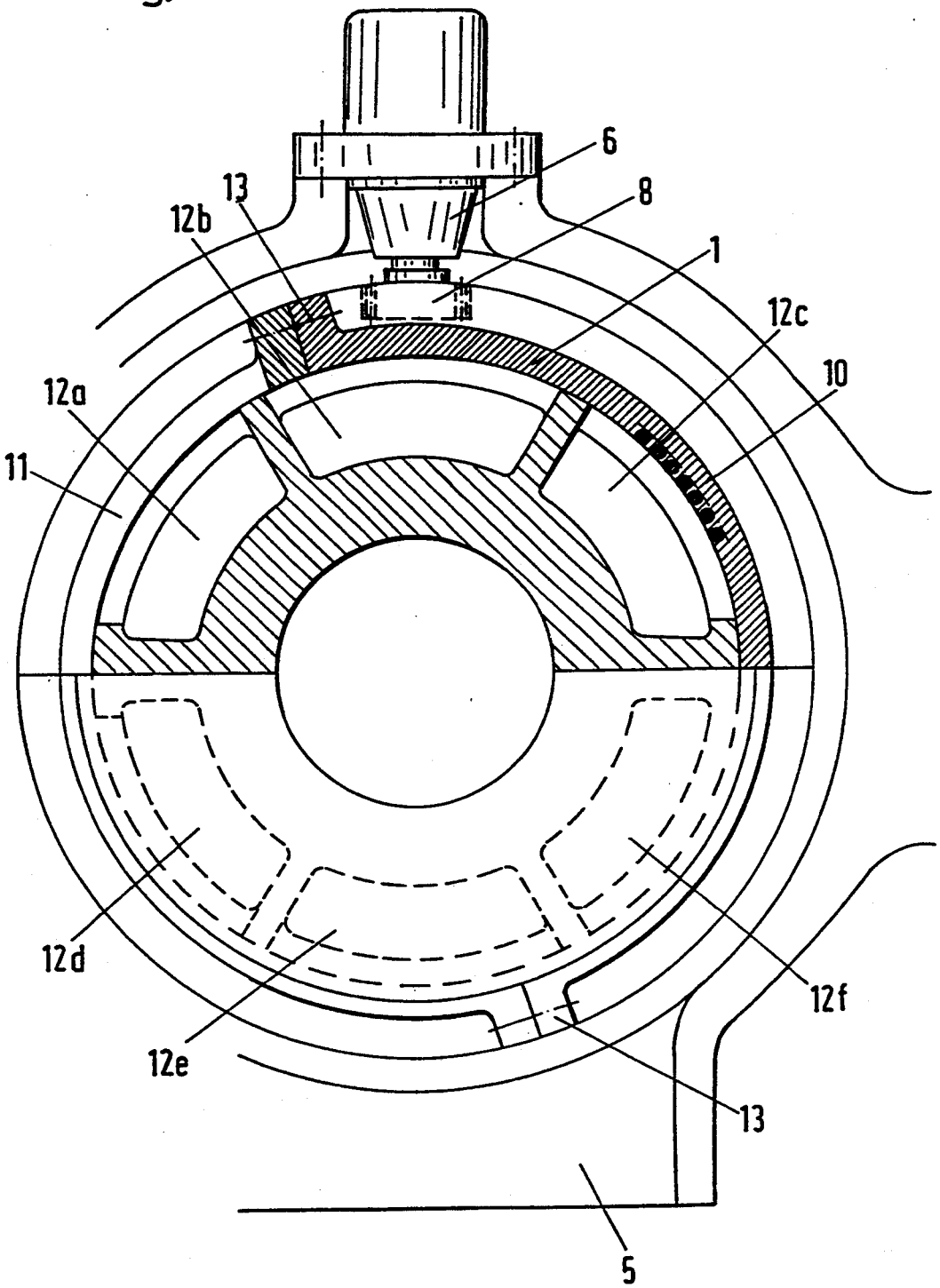
FIG. 4 is a fragmentary, sectional view taken crosswise to the axis of rotation of the regulating stage with a view in the axial direction, of a steam turbine with a radial rotary slide for nozzle group and bypass regulation.
Figure 5:
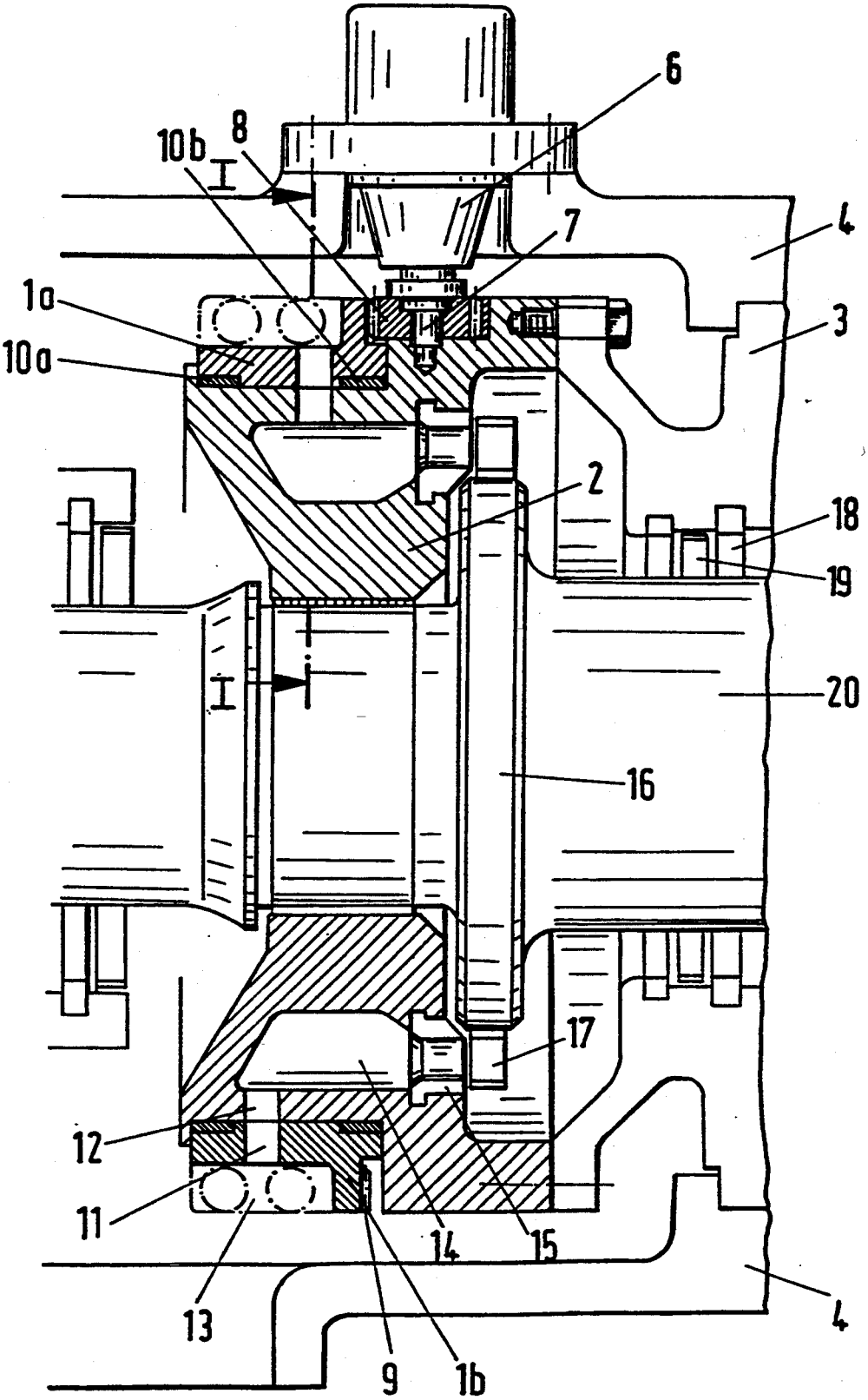
FIG. 5 is a fragmentary, sectional view of the regulating stage of FIG. 4, as viewed from the side, along the axis of rotation.
Figure 6:
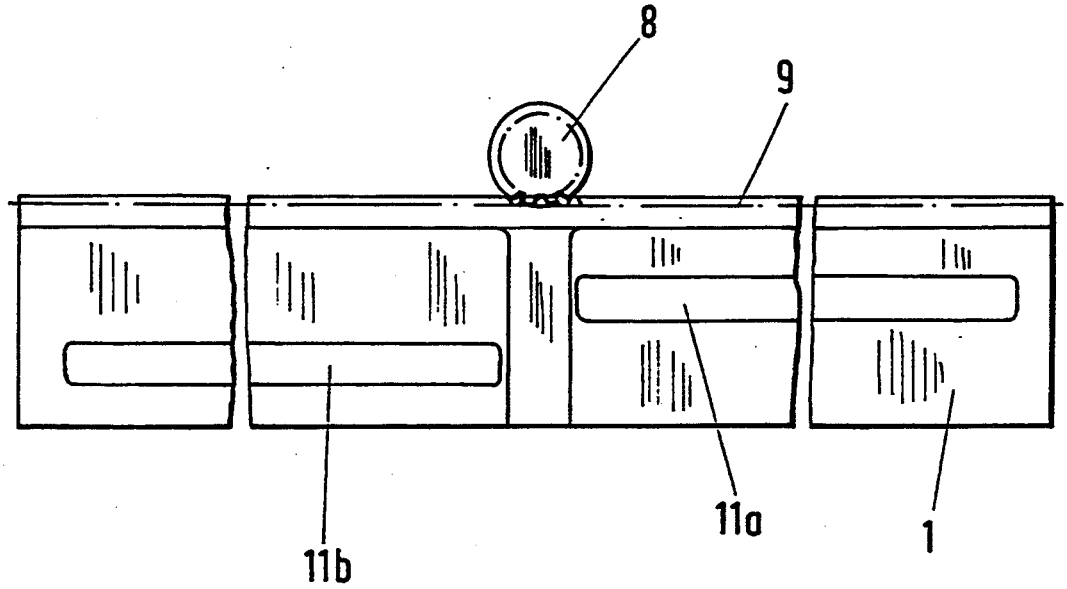
FIG. 6 is a fragmentary, developed view of the radial rotary slide with two control slits being disposed offset from one another and located on different orbits.

In the regulating stage shown in FIGS. 4–6, the rotary slide 1 is constructed as a radial rotary slide, and the channel body 2 is adapted to it. Since the mode of operation is fundamentally the same, the same reference numerals are used. In the view of FIG. 4, it can be seen relatively easily that the various channel inlets 12 may either be assigned to nozzle groups including a plurality of nozzles 15 or to a bypass 24.

I claim:

1. A steam turbine, comprising:

a rotary slide for controlling steam throughput, said rotary slide having control slits formed therein;

a stationary channel body having channel inlets formed therein with which said control slits cooperate for increasingly opening and closing said channel inlets depending on a direction of rotation of said rotary slide at the time;

at least one roller bearing race disposed between said stationary channel body and said rotary slide outside the vicinity of said control slits and said channel inlets, for reducing rotational friction;

at least one of said control slits and at least one of said channel inlets being disposed at each of at least two separate orbits; and one of said channel inlets being opened while others of said channel inlets to be opened remain closed, upon rotation of said rotary slide in a corresponding direction of rotation.

2. The steam turbine according to claim 1, wherein said rotary slide controls steam throughput in combination with a steam offtake.

3. The steam turbine according to claim 1, wherein said rotary slide has two of said control slits formed therein extending over a rotary angle of approximately 180°, and closure and complete opening of said rotary slide define a rotary angle of approximately 180° therebetween.

4. The steam turbine according to claim 1, wherein said rotary slide is split horizontally into first and second rotary slide halves being individually mounted on said channel body and joined together.

5. The steam turbine according to claim 4, including rotary slide parting line flanges joining said rotary slide halves together.

6. The steam turbine according to claim 4, wherein said rotary slide halves each have at least one of said control slits formed therein, and said at least one control slit in said first rotary slide half extends over a different orbit than said at least one control slit in said second rotary slide half.

7. The steam turbine according to claim 1, including at least one nozzle, said channel inlets leading to said at least one nozzle.

8. The steam turbine according to claim 1, including at least one nozzle group, said channel inlets leading to said at least one nozzle group.

9. The steam turbine according to claim 1, including at least one nozzle and at least one bypass, said channel inlets leading to said at least one nozzle and to said at least one bypass.

10. The steam turbine according to claim 1, including at least one nozzle group and at least one bypass, said channel inlets leading to said at least one nozzle group and to said at least one bypass.

11. The steam turbine according to claim 1, including nozzles each opposing one another at the same distance and being acted upon simultaneously with steam through said control slits and said channel inlets.

12. The steam turbine according to claim 1, including nozzle groups each opposing one another at the same distance and being acted upon simultaneously with steam through said control slits and said channel inlets.

13. The steam turbine according to claim 1, wherein said at least one roller bearing race is two roller bearing races between which said control slits and said channel inlets are disposed.

14. The steam turbine according to claim 1, including means for rotatingly driving said rotary slide.

15. The steam turbine according to claim 14, wherein said driving means are an electric servomotor.

16. The steam turbine according to claim 15, wherein said servomotor is mounted in a stationary manner, and including a toothed ring disposed in an outer region of said rotary slide, a drive pinion of said servomotor engaging said toothed ring, and a flexible cardan shaft connecting said servomotor to said drive pinion.

17. The steam turbine according to claim 16, including a turbine housing on which said servomotor is mounted.

18. The steam turbine according to claim 1, including a steam turbine shaft, said channel body being split horizontally into two channel body halves being mounted above said shaft and joined to one another.

19. The steam turbine according to claim 18, wherein said two channel body halves are cast as identical parts with channels having said channel inlets, and said channel inlets of said channels of said channel body are produced by ensuing machining of said cast channel body halves.

20. The steam turbine according to claim 1, wherein said roller bearing races are sunk into said channel body for defining a narrow gap remaining between said rotary slide and said channel body.

21. The steam turbine according to claim 20, including means for sealing off said gap.

22. The steam turbine according to claim 1, wherein said rotary slide has running surfaces sliding over said roller bearing races, and said rotary slide is tempered at least in the vicinity of said running surfaces.

23. The steam turbine according to claim 22, wherein said rotary slide has running surfaces sliding over said roller bearing races, and said rotary slide is detonation-coated at least in the vicinity of said running surfaces.

24. The steam turbine according to claim 1, wherein said rotary slide and said channel body have corresponding annular grooves and annular cams, said rotary slide is rotatably supported on said channel body, and said rotary slide and said channel body interlocking with one another by means of said corresponding annular grooves and annular cams.

25. The steam turbine according to claim 1, including a guide blade support to which said channel body is secured.

26. The steam turbine according to claim 1, wherein said rotary slide is an axial rotary slide to which said channel body is adapted.

27. The steam turbine according to claim 1, wherein said rotary slide is a radial rotary slide to which said channel body is adapted.

* * * * *